US011859837B2

(12) United States Patent
Sadanandan et al.

(10) Patent No.: US 11,859,837 B2
(45) Date of Patent: Jan. 2, 2024

(54) HEATING, VENTILATION, AND AIR CONDITIONING SYSTEM ECONOMIZERS HAVING SLIDING DOORS

(71) Applicant: Rheem Manufacturing Company, Atlanta, GA (US)

(72) Inventors: Chitra Sadanandan, Lewisville, TX (US); Sivakumar Gopalnarayanan, Plano, TX (US)

(73) Assignee: Rheem Manufacturing Company, Atlanta, GA (US)

( * ) Notice: Subject to any disclaimer, the term of this patent is extended or adjusted under 35 U.S.C. 154(b) by 230 days.

(21) Appl. No.: 17/343,853

(22) Filed: Jun. 10, 2021

(65) Prior Publication Data

US 2022/0397295 A1 Dec. 15, 2022

(51) Int. Cl.

| | |
|---|---|
| ***F24F 13/12*** | (2006.01) |
| ***F24F 11/30*** | (2018.01) |
| ***F24F 11/00*** | (2018.01) |
| *F24F 110/20* | (2018.01) |
| *F24F 110/10* | (2018.01) |
| *F24F 13/10* | (2006.01) |

(52) U.S. Cl.

CPC ..... *F24F 11/30* (2018.01); *F24F 11/0008* (2013.01); *F24F 13/12* (2013.01); *F24F 13/105* (2013.01); *F24F 2110/10* (2018.01); *F24F 2110/20* (2018.01)

(58) Field of Classification Search

None

See application file for complete search history.

(56) References Cited

U.S. PATENT DOCUMENTS 4,086,781 A * 5/1978 Brody ..... F24F 11/74 165/250

4,478,056 A 10/1984 Michaels (Continued)

OTHER PUBLICATIONS

PCT, "Invitation to Pay Additional Fees and, Where Applicable, Portest Fee" Application No. PCT/US2022/032473, dated Sep. 21, 2022, 117 pages.

(Continued)

*Primary Examiner* — Jerry-Daryl Fletcher
*Assistant Examiner* — Daniel C Comings
(74) *Attorney, Agent, or Firm* — Eversheds Sutherland (US) LLP

(57) ABSTRACT

The disclosed technology includes devices and systems for an economizer of a heating ventilation and air conditioning (HVAC) system. The disclosed technology can include an economizer for an HVAC system comprising a housing, an air inlet extending through a wall of the housing, a sliding door configured to transition between a closed position and an open position, and a controller configured to cause the sliding door to transition between the closed position and the open position based on temperature data. The sliding door can comprise a first portion forming a barrier and a second portion comprising at least one aperture. In the closed position, the first portion can align with the air inlet and substantially prevent ambient air from moving through the air inlet. In the open position, the second portion can align with the air inlet and permit the ambient air to move through the air inlet.

20 Claims, 10 Drawing Sheets

(56) References Cited

U.S. PATENT DOCUMENTS

| | | | | |
|---|---|---|---|---|
| 4,517,809 | A * | 5/1985 | Hoyt | F24F 12/00 62/183 |
| 4,519,539 | A | 5/1985 | Bussjager et al. | |
| 6,126,540 | A * | 10/2000 | Janu | F24F 11/74 454/236 |
| 7,195,556 | B1 * | 3/2007 | Fichtelman | E04D 13/152 52/95 |
| 10,859,286 | B2 * | 12/2020 | Dorste | F24F 13/12 |
| 2004/0194913 | A1 | 10/2004 | Umebayashi et al. | |
| 2006/0207279 | A1 * | 9/2006 | Daddis | F25D 17/062 62/255 |
| 2012/0222851 | A1 | 9/2012 | Arinez et al. | |
| 2013/0030575 | A1 * | 1/2013 | Dempsey | F24F 11/74 700/276 |
| 2017/0153039 | A1 | 6/2017 | Dorste et al. | |
| 2020/0045852 | A1 * | 2/2020 | Papen | H05K 7/20727 |

OTHER PUBLICATIONS

PCT, "International Search Report & Written Opinion" Application No. PCT/US2022/032473, dated Nov. 14, 2022, 23 pages.

* cited by examiner

HEATING, VENTILATION, AND AIR CONDITIONING SYSTEM ECONOMIZERS HAVING SLIDING DOORS

FIELD OF TECHNOLOGY

The disclosed technology relates generally to heating, ventilation, and air conditioning (HVAC) systems and, more particularly, to economizers used in HVAC systems.

BACKGROUND

Economizers, sometimes included with rooftop units of commercial HVAC systems, are designed to route ambient air (i.e., outdoor air) directly into a building when the ambient air is within a predetermined temperature range and a predetermined humidity range. By routing the ambient air directly into the building, economizers help reduce the overall cost of operating the HVAC system because the building can be cooled without needing to operate the compressor to ultimately provide a cooling effect via the evaporator or by operating the compressor for a shorter duration compared to HVAC systems without an economizer.

As depicted in FIG. 1A, existing economizers 110 can typically be installed in the rooftop unit 102 of the HVAC system 100. When the ambient air is cool and dry enough to be routed into the building 120 without requiring cooling or dehumidification by the evaporator 106, the economizer 110 can open an outdoor air damper 108 so that the air moving device 104 can draw the ambient air into the HVAC system 100 and direct the ambient air into the building 120 through a supply air duct 114. As the air returns through a return air duct 116 to the rooftop unit 102, the economizer 110 can open barometric relief dampers 112 to vent some of the air back to the atmosphere.

Undesirably, many economizers comprise a complex design having multiple dampers and gears actuated by a motor which can lead to increased manufacturing and maintenance costs. To make matters worse, the configuration of existing economizers 110 can also reduce the overall operating efficiency of the HVAC system 100. As depicted in FIG. 1B, the configuration of a typical economizer 110 causes the returning air to be obstructed by the economizer 110 and unevenly distributed across the evaporator 106 when the economizer 110 is not in use. The uneven distribution of air across the evaporator 106 caused by the economizer 110 can lead to a reduced efficiency and can offset or eliminate the benefit of having an economizer 110 in the HVAC system 100. Furthermore, the configuration of the economizer 110 can create a large pressure drop in the HVAC system 100, causing the air moving device 104 to require more power and further reducing the overall efficiency of the HVAC system 100.

What is needed, therefore, is an economizer having reduced complexity and/or that can reduce the negative impact on air distribution and pressure caused by the economizer when not in use. These and other problems are addressed by the technology disclosed herein.

SUMMARY

The disclosed technology relates generally to heating ventilation and air conditioning (HVAC) systems and, more particularly, to economizers used in HVAC systems.

The disclosed technology can include an economizer for an HVAC system that can include a housing, an air inlet extending through a wall of the housing, and a sliding door that can be configured to transition between a closed position and an open position. The sliding door can include a first portion forming a barrier and a second portion having at least one aperture. When the sliding door is in the closed position, the first portion can be aligned with the air inlet and configured to substantially prevent ambient air from moving through the air inlet. When the sliding door is in the open position, the second portion can be aligned with the air inlet and configured to permit the ambient air to move through the air inlet via the at least one aperture.

The economizer can further include a controller in communication with a temperature sensor of the HVAC system. The controller can be configured to receive temperature data from the temperature sensor. The temperature data can be indicative of a temperature of ambient air. In response to determining that the temperature of the ambient air is within a predetermined temperature range, the controller can be configured to output a first control signal to transition the sliding door to the open position. In response to determining that the temperature of the ambient air is not within the predetermined temperature range, the controller can be configured to output a second control signal to transition the sliding door to the closed position.

The controller can be further configured to receive humidity data from a humidity sensor of the HVAC system. The humidity data can be indicative of a humidity of ambient air. In response to determining that the humidity of the ambient air is within a predetermined humidity range, the controller can be configured to output a third control signal to transition the sliding door to the open position. In response to determining that the humidity of the ambient air is not within the predetermined humidity range, the controller can be configured to output a fourth control signal to transition the sliding door to the closed position.

The first portion can comprise a plurality of panels that can be configured to align to create a seal and prevent airflow. The sliding door can further include a plurality of sealing elements affixed to the plurality of panels such that, when the plurality of panels is planarly aligned, the plurality of sealing elements create a seal between adjacent panels of the plurality of panels.

The second portion can include a screen, a plurality of louvers, and/or a plurality of panels. If the second portion includes a plurality of panels, the plurality of panels can be spaced apart from each other such that the plurality of panels can permit the ambient air to be drawn into the housing.

The economizer can include a barometric relief damper configured to permit at least a portion of return air to exit the housing. When the sliding door is in the open position, the sliding door can be configured to direct at least a portion of the return air toward the barometric relief damper to exit the housing.

The sliding door can be configured to move along a track and include a motor that is configured to move the sliding door along the track. The track can be configured to direct the first portion of the sliding door into an airflow path of return air to at least partially obstruct the airflow path of return air when the sliding door is in the open position. The sliding door can be configured to move to the open position when an ambient temperature and/or humidity is less than a predetermined value.

The disclosed technology can include an HVAC system that can include the economizer described herein. The HVAC system can include a heat exchanger and an air moving device that can be configured to move air across an outer surface of the heat exchanger. The HVAC system can include a compressor. The controller can be further configured to output a control signal to the compressor to cause the compressor to circulate refrigerant through the heat exchanger when the sliding door is in the closed position. The controller can be further configured to output a control signal to the compressor to cause the compressor to deactivate when the sliding door is in the open position. The HVAC system can include a perforated plate that can be configured to direct return air across the heat exchanger. The perforated plate can include a first portion having a first plurality of perforations having a first cumulative flow area and a second portion having a second plurality of perforations having a second cumulative flow area. The first cumulative flow area can be greater than the second cumulative flow area.

The disclosed technology can include an HVAC system having a heat exchanger, an air moving device that can be configured to move air across an outer surface of the heat exchanger, and a perforated plate that can be configured to direct a flow of the air moved across the outer surface of the heat exchanger. The perforated plate can include a first portion having a first plurality of perforations having a first cumulative flow area and a second portion having a second plurality of perforations having a second cumulative flow area. The first cumulative flow area can be greater than the second cumulative flow area and can be configured to permit a greater amount of the air to pass across the outer surface of the heat exchanger than the second cumulative flow area.

The HVAC system can include an economizer having a sliding door that can be configured to be transitioned between a closed position and an open position. The sliding door can include a first portion forming a barrier and a second portion comprising at least one aperture. When the sliding door is in the closed position, the first portion can be aligned with an air inlet of the heat exchanger and can be configured to substantially prevent ambient air from moving through the air inlet. When the sliding door is in the open position, the second portion can be configured to permit the ambient air to move through the air inlet via the at least one aperture.

The HVAC system can further include a controller in communication with a temperature sensor of the HVAC system. The controller can be configured to receive temperature data from the temperature sensor. The temperature data can be indicative of a temperature of ambient air. In response to determining that the temperature of the ambient air is within a predetermined temperature range, the controller can be configured to output a first control signal to transition the sliding door to the open position. In response to determining that the temperature of the ambient air is not within the predetermined temperature range, the controller can be configured to output a second control signal to transition the sliding door to the closed position.

The controller can be further configured to receive humidity data from a humidity sensor of the HVAC system. The humidity data can be indicative of a humidity of ambient air. In response to determining that the humidity of the ambient air is within a predetermined humidity range, the controller can be configured to output a third control signal to transition the sliding door to the open position. In response to determining that the humidity of the ambient air is not within the predetermined humidity range, the controller can be configured to output a fourth control signal to transition the sliding door to the closed position.

The sliding door can be configured to move along a track. The track can include an extending portion that can be configured to direct the sliding door into an interior of the economizer to at least partially obstruct an airflow path of return air when the sliding door is in the open position.

The HVAC system can include a compressor that can be configured to circulate refrigerant through the heat exchanger when the sliding door is in the closed position and to deactivate when the sliding door is in the open position.

The controller can be further configured to output a control signal to the compressor to cause the compressor to circulate refrigerant through the heat exchanger when the sliding door is in the closed position and output a control signal to the compressor to cause the compressor to deactivate when the sliding door is in the open position.

Additional features, functionalities, and applications of the disclosed technology are discussed herein in more detail.

BRIEF DESCRIPTION OF THE DRAWINGS

The accompanying drawings, which are incorporated in and constitute a part of this specification, illustrate various aspects of the presently disclosed subject matter and serve to explain the principles of the presently disclosed subject matter. The drawings are not intended to limit the scope of the presently disclosed subject matter in any manner.

DETAILED DESCRIPTION

Figure 1A:
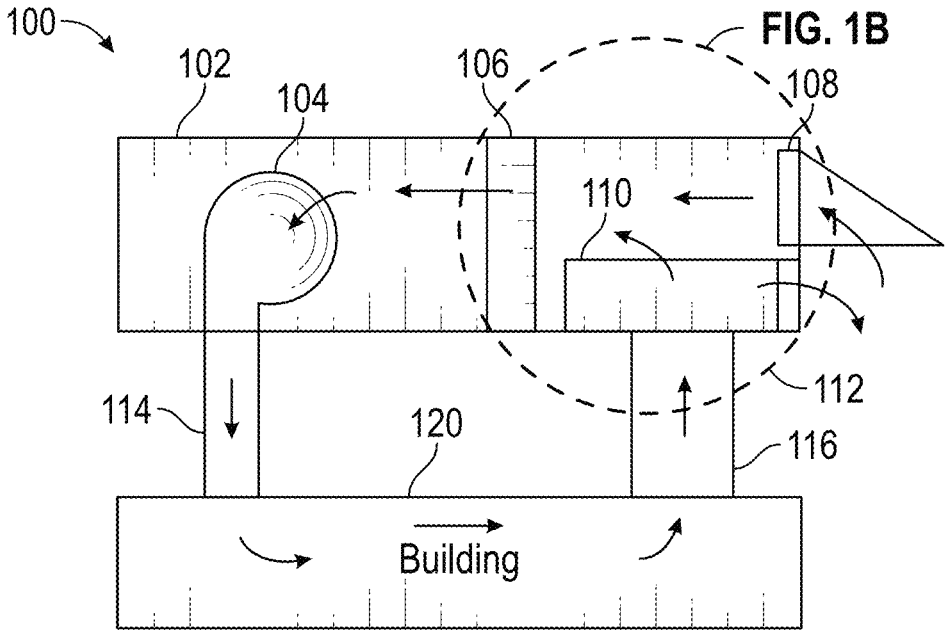
FIG. 1A (Prior Art)
FIG. 1A illustrates a schematic diagram of an existing HVAC system having an economizer.

The disclosed technology includes devices and systems for an economizer used in HVAC systems. In particular, the disclosed technology includes an economizer of an HVAC system that can reduce the inefficiencies common to many existing economizer designs by reducing the pressure drop and airflow maldistribution caused by the economizer during normal heating or cooling operations. The disclosed technology, for example, includes an economizer having a sliding door that can be opened and closed to selectively intake ambient air depending on the temperature of the ambient air. When the sliding door is closed, the sliding door can be configured to move out of the way of the returning air such that returning air from the HVAC system is permitted to flow to the evaporator without substantial obstruction, thereby avoiding the pressure drop and uneven air distribution common to existing economizer designs. Furthermore, when the sliding door is opened, the sliding door can be configured to redirect at least some of the returning air through barometric relief dampers to release the redirected returning air to the atmosphere. Further configurations and advantages of the disclosed technology will become apparent throughout this disclosure.

Although various aspects of the disclosed technology are explained in detail herein, it is to be understood that other aspects of the disclosed technology are contemplated. Accordingly, it is not intended that the disclosed technology is limited in its scope to the details of construction and arrangement of components expressly set forth in the following description or illustrated in the drawings. The disclosed technology can be implemented and practiced or carried out in various ways. In particular, the presently disclosed subject matter is described in the context of being devices and systems for an economizer of an HVAC system. The present disclosure, however, is not so limited, and can be applicable in other contexts. The present disclosure, for example, can include devices and systems for use with any air conditioning, heat pump system, or air handling system, including packaged air conditioning systems and heat pumps, rooftop systems, split air conditioning systems and heat pumps, or other air handling systems that are designed to provide reconditioned and/or fresh air to a conditioned space. Accordingly, when the present disclosure is described in the context of an economizer of an HVAC system, it will be understood that other implementations can take the place of those referred to.

It should also be noted that, as used in the specification and the appended claims, the singular forms "a," "an," and "the" include plural references unless the context clearly dictates otherwise. References to a composition containing "a" constituent is intended to include other constituents in addition to the one named.

Also, in describing the disclosed technology, terminology will be resorted to for the sake of clarity. It is intended that each term contemplates its broadest meaning as understood by those skilled in the art and includes all technical equivalents which operate in a similar manner to accomplish a similar purpose.

Ranges may be expressed herein as from "about" or "approximately" or "substantially" one particular value and/or to "about" or "approximately" or "substantially" another particular value. When such a range is expressed, the disclosed technology can include from the one particular value and/or to the other particular value. Further, ranges described as being between a first value and a second value are inclusive of the first and second values. Likewise, ranges described as being from a first value and to a second value are inclusive of the first and second values.

It is also to be understood that the mention of one or more method steps does not preclude the presence of additional method steps or intervening method steps between those steps expressly identified. Moreover, although the term "step" can be used herein to connote different aspects of methods employed, the term should not be interpreted as implying any particular order among or between various steps herein disclosed unless and except when the order of individual steps is explicitly required. Further, the disclosed technology does not necessarily require all steps included in the methods and processes described herein. That is, the disclosed technology includes methods that omit one or more steps expressly discussed with respect to the methods described herein.

Herein, the use of terms such as "having," "has," "including," or "includes" are open-ended and are intended to have the same meaning as terms such as "comprising" or "comprises" and not preclude the presence of other structure, material, or acts. Similarly, though the use of terms such as "can" or "may" are intended to be open-ended and to reflect that structure, material, or acts are not necessary, the failure to use such terms is not intended to reflect that structure, material, or acts are essential. To the extent that structure, material, or acts are presently considered to be essential, they are identified as such.

The components described hereinafter as making up various elements of the disclosed technology are intended to be illustrative and not restrictive. Many suitable components that would perform the same or similar functions as the components described herein are intended to be embraced within the scope of the disclosed technology. Such other components not described herein can include, but are not limited to, similar components that are developed after development of the presently disclosed subject matter.

Figure 2A:
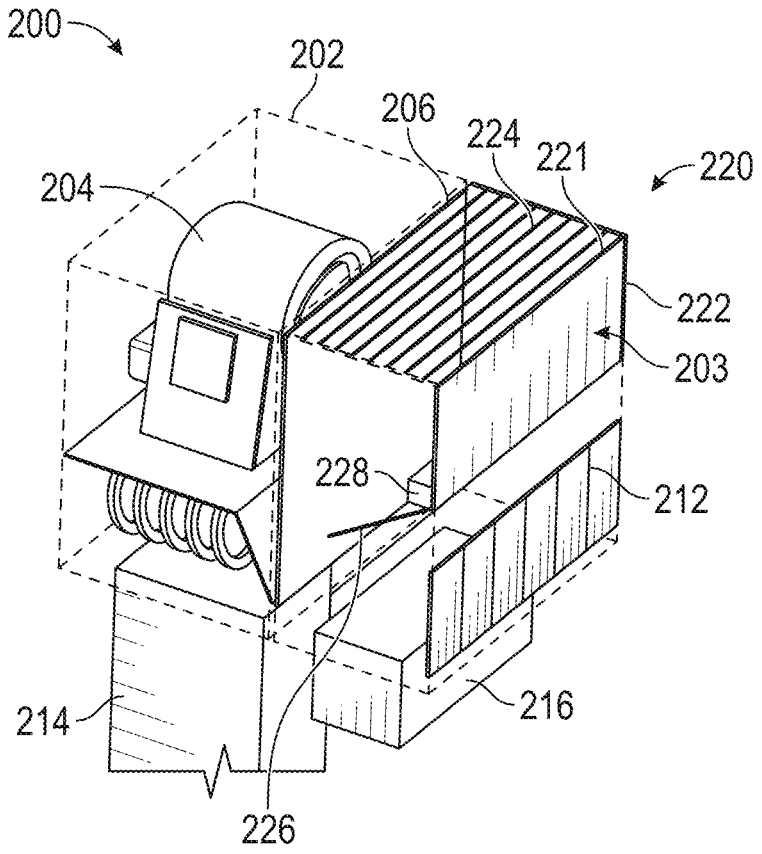
FIG. 2A illustrates a partially transparent, perspective view of an HVAC system having an example economizer in a closed position, in accordance with the disclosed technology.
Figure 2B:
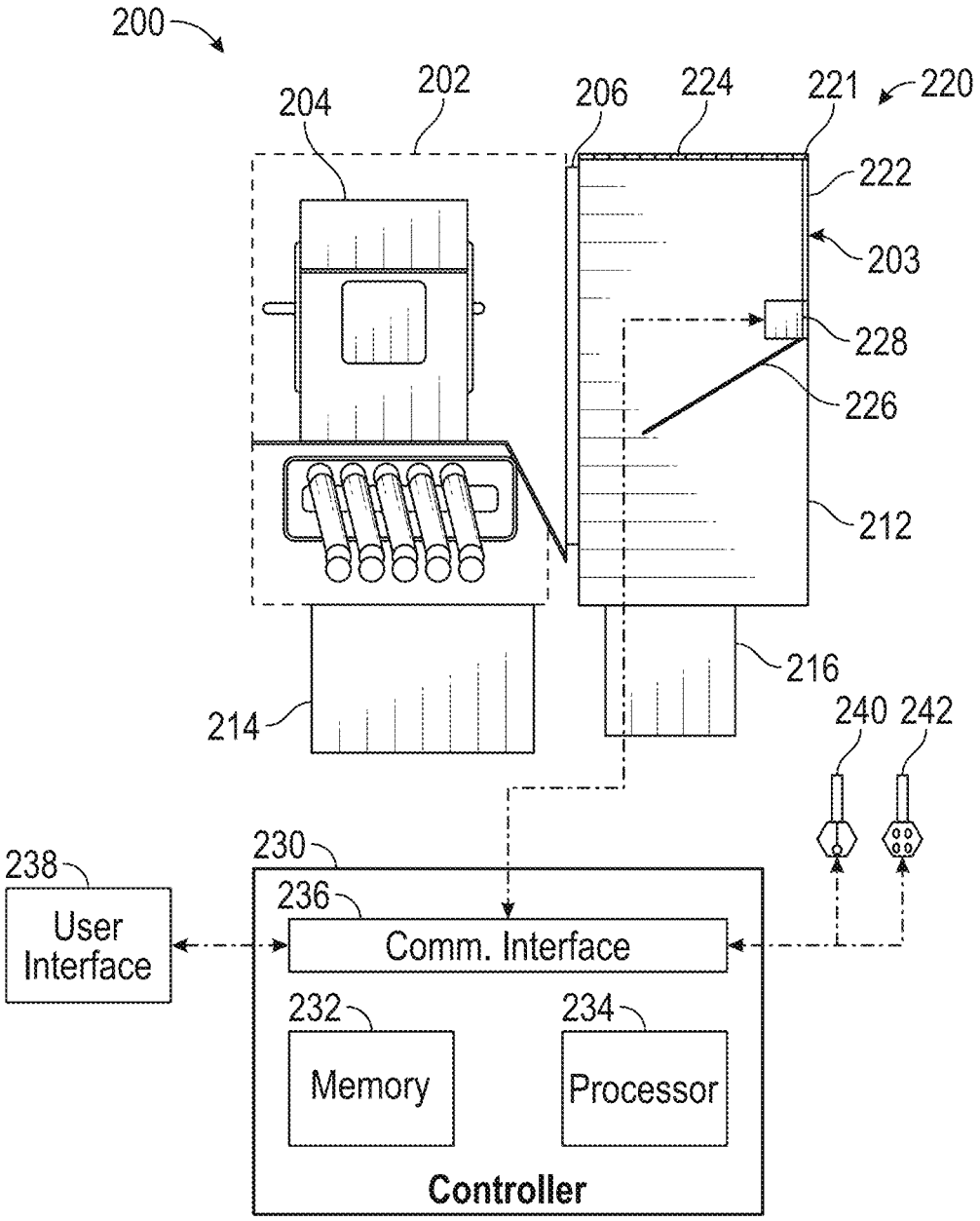
FIG. 2B illustrates a partially transparent, side view of an HVAC system having an example economizer in a closed position, in accordance with the disclosed technology.

Referring now to the drawings, in which like numerals represent like elements, the present disclosure is herein described. FIGS. 2A and 2B illustrate a heating ventilation and air conditioning (HVAC) system 200 having an economizer 220 in a closed position, in accordance with the disclosed technology (FIG. 2A is a perspective view while FIG. 2B is a side view of the HVAC system 200, with both figures being partially transparent for clarity of description). The HVAC system 200 can include an packaged unit 202 (e.g., a rooftop unit, a wall-mounted unit, a ground unit, an outdoor unit or other HVAC unit) having an air moving device 204 that can be configured to draw air through an evaporator 206 and direct the air through a supply air duct 214 to a building or ventilated space. Air can be returned to the packaged unit 202 through a return air duct 216 and either circulated back through the evaporator 206 or released to the atmosphere through barometric relief dampers 212. As will be appreciated by one of skill in the art, although the term 'evaporator' is used herein to describe the evaporator 206, the evaporator 206 is a heat exchanger coil that can also be operated as a condenser when the HVAC system 200 is in a heating mode.

The air moving device 204 can be any type of air moving device configured to draw or move air through the HVAC system 200. For example, the air moving device 204 can be a draft inducer, a fan, a blower, or any other air moving device configured to move air through the system. The evaporator 206 can be any type of evaporator 206 that can be used to cool air passing around the evaporator 206. The evaporator 206, for example, can be an A-coil, an N-coil, a Z-coil, a slab coil, a cased coil, an uncased coil, a micro-channel coil, or any other suitable type of evaporator for the application.

Figure 3A:
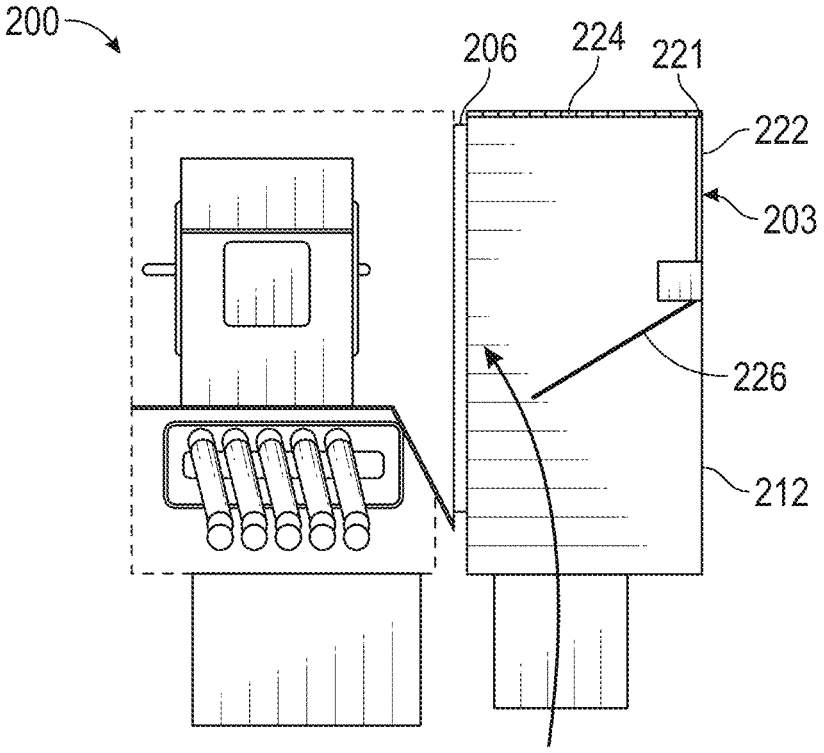
FIG. 3A illustrates a partially transparent, side view of an HVAC system having an example economizer in a closed position and depicting airflow through the economizer, in accordance with the disclosed technology.

The economizer 220 can include a sliding door 221 having a sealing portion 222 that can be configured to prevent airflow from passing through the sliding door 221 and into the HVAC system 200 when the sliding door 221 is in the closed position and a perforated portion 224 that can be configured to permit airflow to pass through the sliding door 221 and into the HVAC system 200 when the sliding door 221 is in the open position. The sealing portion 222 can include a plurality of connected panels configured to align and form a seal when in the closed position. The sealing portion 222 can be configured to provide an airtight seal when in the closed position thereby preventing ambient air from entering the economizer 220 and redirecting return air through the evaporator 206 (as illustrated in FIG. 3A). Alternatively, the sealing portion 222 can be configured to provide less than an airtight seal when in closed position. That is, the sealing portion 222 can optionally be configured to prevent a substantial portion, but not necessarily all, airflow between interior and exterior portions of the economizer 220. The sealing portion 222 can be made from metal, plastic, composite material, wood, or other materials capable of withstanding the pressures created by operation of the HVAC system 200. The plurality of panels can include a sealing material or a gasket material (e.g., around the perimeter of the panels) that can help to ensure a suitable seal is formed between the panels to meet the sealing requirements of the HVAC system 200. Alternatively, or in addition, the sealing portion 222 can include a continuous flexible material that is configured to bend when the economizer is actuated between the closed position and the open position. If the sealing portion 222 is made from a flexible material, the sealing portion 222 can be made from rubber, flexible metal, plastic, Kevlar, composite materials, or any other material that can bend when the sliding door 221 is actuated between the closed position and the open position. As will be appreciated by one of skill in the art, the sealing portion 222 can comprise many different configurations that can each be capable of preventing air from entering the packaged unit 202 when the HVAC system 200 is in operation and the sliding door 221 is in the closed position.

Figure 4B:
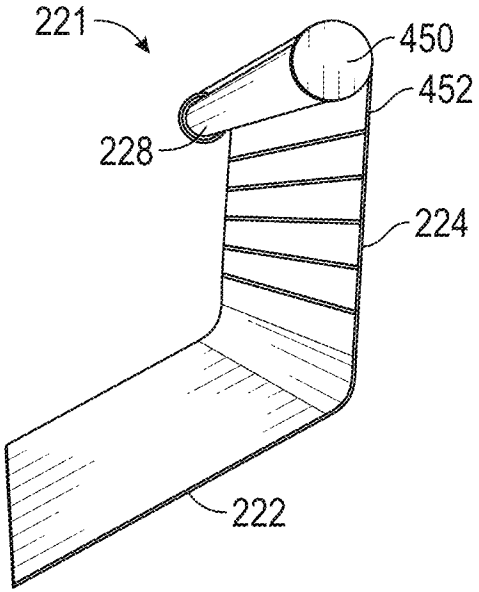
FIG. 4B illustrates a perspective view of another example economizer door of an HVAC system, in accordance with the disclosed technology.
Figure 4C:
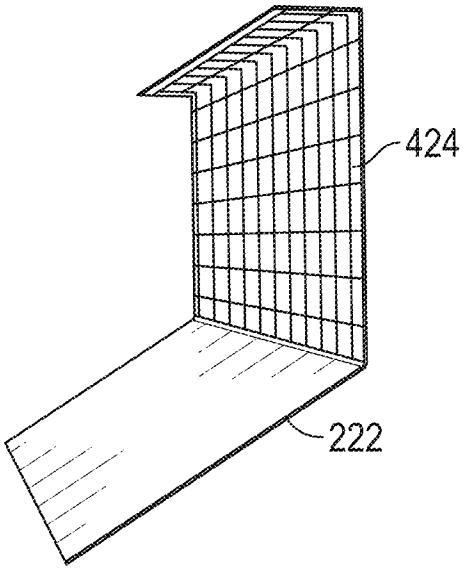
FIG. 4C illustrates a perspective view of another example economizer door of an HVAC system, in accordance with the disclosed technology.

The perforated portion 224 can include a plurality of panels having a gap between adjacent panels such that air is permitted to flow through the perforated portion 224 and into the HVAC system 200 when in operation. The plurality of panels of the perforated portion 224 can be angled to form a louver that can help prevent precipitation or foreign objects from entering the HVAC system 200 when the sliding door 221 is in the open position. For example, as the perforated portion 224 is moved into the open position, the perforated portion 224 can be positioned over the opening 203 and comprise panels that are angled downward and project outwardly from the opening to permit air to enter the HVAC system 200 while helping to prevent precipitation and foreign objects from entering the HVAC system 200. Alternatively, or in addition, the perforated portion 224 can comprise perforated panels or a grille 424 (or screen or mesh), such as is depicted in FIG. 4C. If the perforated portions 224 comprises perforated panels, each perforated panel can form a frame with one or more perforations within the frame such that air is permitted to flow through the perforated panel. For example, a perforated panel can include a continuous piece of material having one or more holes, slits, or other apertures to permit air to flow through the perforated panel. Alternatively or in addition, the perforated portion 224 can include multiple panels spaced apart from each other such that the multiple panels permit air to flow into the HVAC system 200. Similar to the sealing portion 222, the perforated portion 224 can be configured to bend when the economizer is actuated between the closed position and the open position. If the perforated portion 224 is made from a flexible material, the sealing portion 222 can be made from rubber, flexible metals, plastic, Kevlar, composite materials, or any other material that can bend when the sliding door 221 is actuated between the closed position and the open position. As will be appreciated by one of skill in the art, the perforated portion 224 can comprise many different configurations that can each be capable of permitting air to enter the packaged unit 202 when the HVAC system 200 is in operation and the sliding door 221 is in the open position.

Figure 2C:
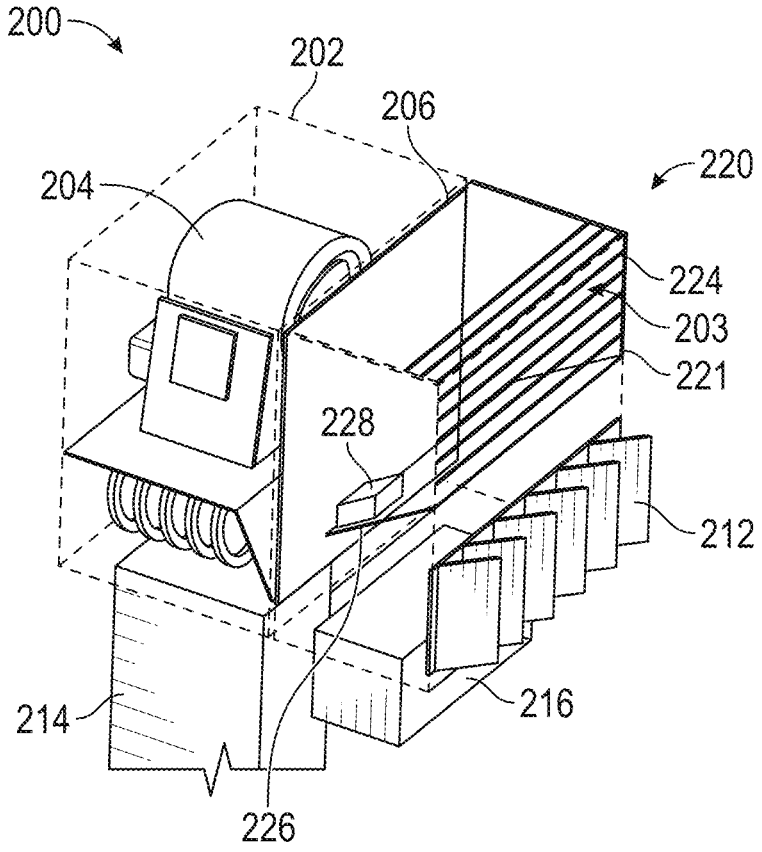
FIG. 2C illustrates a partially transparent, perspective view of an HVAC system having an example economizer in an open position, in accordance with the disclosed technology.
Figure 2D:
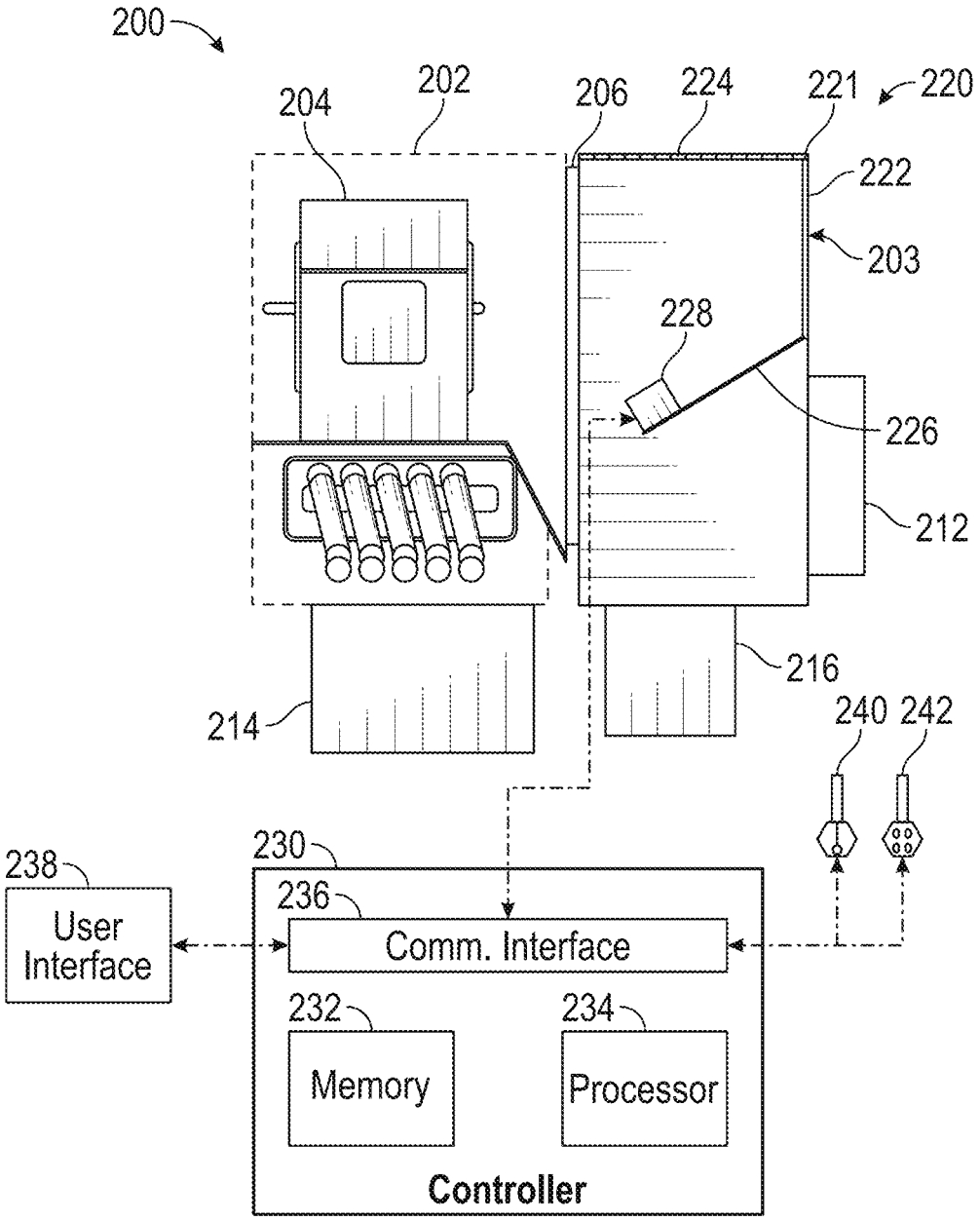
FIG. 2D illustrates a partially transparent, side view of an HVAC system having an example economizer in an open position, in accordance with the disclosed technology.
Figure 3B:
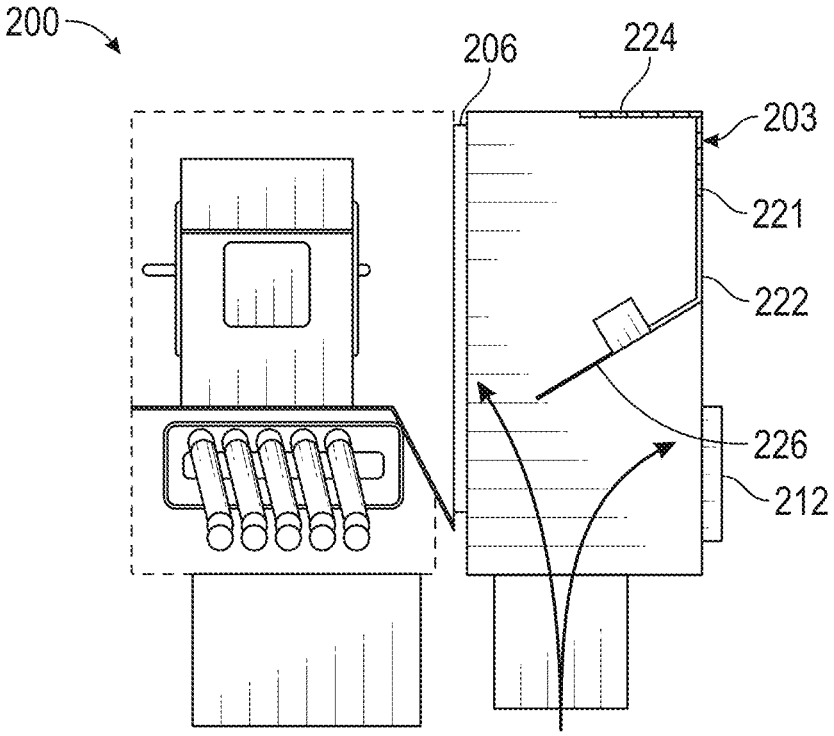
FIG. 3B illustrates a partially transparent, side view of an HVAC system having an example economizer in a partially open position and depicting airflow through the economizer, in accordance with the disclosed technology.
Figure 3C:
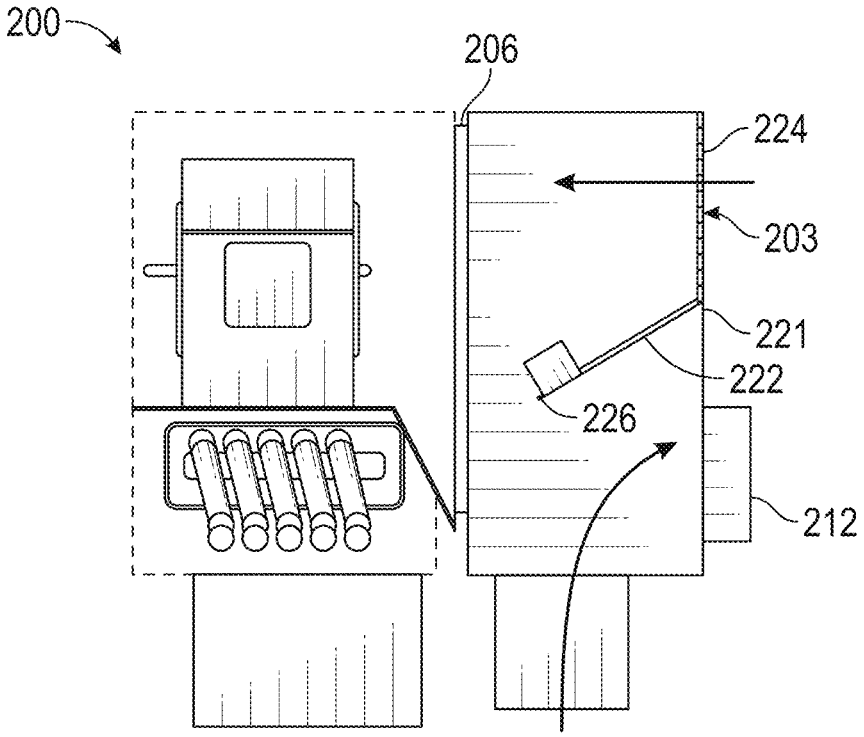
FIG. 3C illustrates a partially transparent, side view of an HVAC system having an example economizer in an open position and depicting airflow through the economizer, in accordance with the disclosed technology.

The sealing portion 222 and the perforated portion 224 can be connected to each other and be configured to open and close together to form the sliding door 221. For example, when the sliding door 221 is in the closed position (as depicted in FIGS. 2A and 2B), the sealing portion 222 can align with the opening 203 of the packaged unit 202 to prevent air from entering into the packaged unit 202. The sliding door 221 can be actuated from the closed position to an open position (e.g., as depicted in FIGS. 2C and 2D) by moving the sealing portion 222 and the perforated portion 224 together such that the perforated portion 224 aligns with the opening 203 of the packaged unit 202 to permit air to enter the packaged unit 202 (as further illustrated in FIG. 3C depicting airflow through the economizer 220). The sealing portion 222 and the perforated portion 224 can be the same size or different sizes. Furthermore, the sealing portion 222 can be sized to cover or substantially cover the opening 203 to prevent air from entering the HVAC system 200 while the perforated portion 224 can be configured to at least partially uncover the opening 203 such that air is permitted to flow through the perforated portion 224 and into the HVAC system 200.

The sealing portion 222 can be configured to redirect some of the return air through the barometric relief dampers 212 when the sliding door 221 is in the open position. As depicted in FIGS. 2C and 2D, the sealing portion 222 can be moved into an angled position such that at least a portion of the return air being drawn up through the return air duct 216 can be directed by the sealing portion 222 through the barometric relief dampers 212. The barometric relief dampers 212 can be configured to open by the pressure caused by the return air being redirected by the sealing portion 222 when the sliding door 221 is in the open position. In this way, the sliding door 221 can be configured to circulate air through the opening 203 of the HVAC system 200, through the building, and then out through the barometric relief damper 212 to the atmosphere such that fresh air is circulated through the HVAC system 200.

The sealing portion 222 and the perforated portion 224 can be configured to slide between the open position and the closed position by moving along a track 226 configured to guide the sliding door 221 between the open and closed positions. The track 226 can be mounted to an inside surface of the packaged unit 202. Alternatively, or in addition, the track 226 can be mounted to a frame configured to support the track 226 and the sliding door 221. The track 226 can include an extending portion that can extend into an interior portion of the economizer 220. The extending portion can be angled such that the extending portion can guide the sealing portion 222 into an airflow path at an appropriate angle and to an appropriate length for redirecting a predetermined amount of the return air when the sliding door 221 is in the open position. In this way, the sealing portion 222 can be configured to direct at least a portion of the return air through the barometric relief dampers 212. Furthermore, because the sliding door 221 can be moved along the track 226 back to the closed position, the sliding door 221 can be moved completely out of the way of the returning air when the sliding door 221 is in the closed position. By moving the sliding door 221 completely out of the way of the returning air, the large pressure drop caused by existing economizer designs (i.e., economizer 110) can be reduced or altogether eliminated to increase the overall efficiency of the HVAC system 200. The sealing portion 222 and the perforated portion 224 can comprise wheels configured to facilitate movement of the sliding door 221 along the track 226. Alternatively, the sealing portion 222 and the perforated portion 224 can simply be configured to slide along the track 226 without the aid of wheels.

Figure 4A:
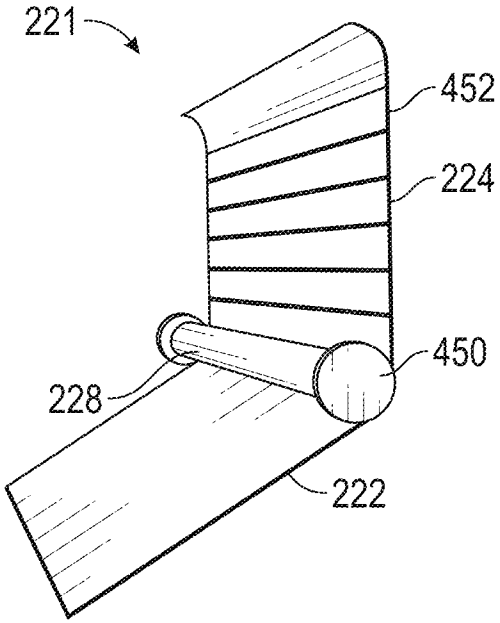
FIG. 4A illustrates a perspective view of an example economizer door of an HVAC system, in accordance with the disclosed technology.

The sliding door 221 can be actuated between the open position and the closed position by a motor system 228. The motor system 228 can be mounted to the inside surface of the packaged unit 202 or a frame configured to support the motor system 228. Alternatively, the motor system 228 can be mounted to the sealing portion 222 or the perforated portion 224 and be configured to move along with the sliding door 221 when it is actuated between the open position and the closed position. The motor system 228 can include an electric motor that is configured to actuate the sliding door 221 between the open position and the closed position when the electric motor is energized. The motor system 228 can include gears, sprockets, pulleys, and/or other similar devices that can transfer the mechanical energy generated by the electric motor to the sliding door 221 to actuate the sliding door 221. For example, as depicted in FIGS. 4A and 4B, the motor system 228 can be configured to engage a sprocket 450 that can engage a chain 452 that runs along an edge of the sealing portion 222 and/or the perforated portion 224. In this way, the motor system 228 can turn the sprocket 450 and engage the chain 452 to actuate the sliding door 221 between the open and closed positions. The sprocket 450 can be mounted near a top or a bottom of the perforated portion 224 when the sliding door is in the open position. The sprocket 450 can be a gear or pulley and the chain 452 can be a chain, corresponding gear teeth mounted on the sliding door 221, a cable, or any other suitable component that can be engaged by the sprocket 450.

The motor system 228 can be in communication with a controller 230 that is configured to output a control signal to energize the motor system 228 and actuate the sliding door 221. The controller 230 can be configured to determine when the sliding door 221 should be actuated between the open position and the closed position. For example, the controller 230 can be configured to receive temperature data from a temperature sensor 240 and humidity data from a humidity sensor 242 and determine, based on the temperature data and/or the humidity data, that the sliding door 221 should be actuated to either the open or closed position. As will be appreciated by one of skill in the art, the controller 230 can be additionally or alternatively configured to receive data from other types of sensors in the HVAC system 200 and determine, based on data received from the sensor(s), whether the sliding door 221 should be actuated between the open and closed position. For example, and not limitation, the controller 230 can be configured to receive data from a refrigerant gas sensor (e.g., a sensor configured to detect a refrigerant leak of the evaporator 206), a presence sensor (e.g., a sensor configured to detect a presence of an occupant in the corresponding building, room, or area), a carbon monoxide or dioxide sensor, one or more air quality sensors, or any other sensor that can be configured to detect a condition of or near the HVAC system 200 (e.g., detect indoor and/or outdoor environmental conditions). The controller 230 can be configured to determine, based on the received sensor data, that the sliding door 221 should be actuated between the open or the closed position. For example, the controller 230 can determine that the sliding door 221 should be actuated to an open position based on receiving data from the refrigerant gas sensor or carbon monoxide sensor indicating that a refrigerant leak or carbon monoxide is present thereby venting harmful refrigerant gasses or carbon monoxide to the atmosphere rather than into the building. As another example, the controller 230 can determine that the sliding door 221 should be actuated to either the open or closed position based on the presence sensor indicating that an occupant is present in the building. In other words, the controller 230 can be configured to control the sliding door 221 based on a condition of an occupant being present in the building or absent from the building. As another example, the controller 230 can be configured to actuate the sliding door 221 to the closed position based on receiving data from the air quality sensors indicating that the outdoor air quality is below a threshold quality and should not be circulated into the building.

The temperature sensor 240 can be configured to detect a temperature of the ambient air and output the temperature data to the controller 230. Similarly, the humidity sensor 242 can be configured to detect a humidity level of the ambient air and output the humidity data to the controller 230. If the controller 230, for example, determines that the ambient temperature is less than a threshold temperature and that the humidity is less than a threshold humidity level, the controller 230 can output a control signal to actuate the sliding door 221 from the closed position to the open position to permit ambient air to enter the HVAC system 200 and cool the building or ventilated space. On the other hand, if the controller 230 determines that the ambient temperature is greater than or equal to a threshold temperature or that the humidity is greater than or equal to a threshold humidity level, the controller 230 can output a control signal to actuate the sliding door 221 from the open position to the closed position to prevent ambient air from entering the HVAC system 200.

The controller 230 can determine, based on the temperature data, humidity data, or other sensor data, that the sliding door 221 should be partially actuated (moved to a position somewhere between fully open and fully closed) to help regulate the temperature or air quality of the building or ventilated space. As illustrated in FIG. 3B, by opening the sliding door 221 to a position between fully open and fully closed, the economizer 220 can permit ambient air to enter the economizer 220 and direct return air through the evaporator 206 as well as out the barometric relief dampers 212. For example, if the controller 230 determines that only a small amount of ambient air should be circulated through the building (e.g., if the temperature of the ambient air is much cooler than the temperature of the air inside of the building), then the controller 230 can output a control signal to move the sliding door 221 to a suitable position between fully open and fully closed to help maintain the temperature or air quality of the building or ventilated space. The controller 230 can be configured to continue to monitor the temperature of the ambient air and the air inside of the building or ventilated space and output a control signal to change a position of the sliding door 221 to maintain the temperature of the air inside of the building or ventilated space within a predetermined temperature range.

The controller 230 can be further configured to output a control signal to the evaporator 206 based on the ambient temperature or a position of the sliding door 221. For example, if the controller 230 determines, based at least in part on the temperature data received from the temperature sensor 240, that the ambient temperature is less than a threshold temperature, the controller 230 can output a control signal to turn off the evaporator 206 (e.g., turn off a compressor configured to circulate refrigerant through the evaporator 206). Alternatively, or in addition, the controller 230 can be configured to output a control signal to turn off the evaporator 206 when the sliding door 221 is in the open position. In both instances, the HVAC system 200 can be configured to conserve energy by not operating the evaporator 206 when it is not needed to cool the building or ventilated space. In other examples, the controller 230 can determine whether the evaporator 206 should be operated in addition to having the economizer 220 in an open position. For example, the controller 230 can determine, based on the ambient air temperature and the temperature of the air inside of the building or ventilated space, whether to output a control signal to turn on the evaporator 206 to provide further cooling to the air being supplied to the building or ventilated space. In other examples, the controller 230 can determine whether to turn on the evaporator 206 based on a temperature of mixed air (i.e., the ambient air mixed with the returning air) being directed across the outer surface of the evaporator 206.

The controller 230 can be further configured to output a control signal to the barometric relief dampers 212 based on the ambient temperature or a position of the sliding door 221. For example, if the controller 230 determines, based at least in part on the temperature data received from the temperature sensor 240, that the ambient temperature is less than a threshold temperature, the controller 230 can output a control signal to open the barometric relief dampers 212. Alternatively, or in addition, the controller 230 can be configured to output a control signal to open the barometric relief dampers 212 when the sliding door 221 is in the open position. In this way, the controller 230 can ensure that the air drawn into the HVAC system 200 is able to be circulated through the building or ventilated space and released to the atmosphere to ensure fresh and cool ambient air is circulated through the building. Furthermore, as will be appreciated by one of skill in the art, by opening the barometric relief dampers 212, the air pressure within the HVAC system 200 and the building or ventilated space can be maintained at a suitable pressure level.

The controller 230 can have a memory 232, a processor 234, and a communication interface 236. The controller 230 can be a computing device configured to receive data, determine actions based on the received data, and output a control signal instructing one or more components of the HVAC system 200 to perform one or more actions. One of skill in the art will appreciate that the controller 230 can be installed in any location, provided the controller 230 is in communication with at least some of the components of the system. Furthermore, the controller 230 can be configured to send and receive wireless or wired signals and the signals can be analog or digital signals. The wireless signals can include Bluetooth™, BLE, WiFi™, ZigBee™, infrared, microwave radio, or any other type of wireless communication as may be suitable for the particular application. The hard-wired signal can include any directly wired connection between the controller and the other components described herein. Alternatively, the components can be powered directly from a power source and receive control instructions from the controller 230 via a digital connection. The digital connection can include a connection such as an Ethernet or a serial connection and can utilize any suitable communication protocol for the application such as Modbus, fieldbus, PROFIBUS, SafetyBus p, Ethernet/IP, or any other suitable communication protocol for the application. Furthermore, the controller 230 can utilize a combination of wireless, hard-wired, and analog or digital communication signals to communicate with and control the various components. One of skill in the art will appreciate that the above configurations are given merely as non-limiting examples and the actual configuration can vary depending on the particular application.

The controller 230 can include a memory 232 that can store a program and/or instructions associated with the functions and methods described herein and can include one or more processors 234 configured to execute the program and/or instructions. The memory 232 can include one or more suitable types of memory (e.g., volatile or non-volatile memory, random access memory (RAM), read only memory (ROM), programmable read-only memory (PROM), erasable programmable read-only memory (EPROM), electrically erasable programmable read-only memory (EEPROM), magnetic disks, optical disks, floppy disks, hard disks, removable cartridges, flash memory, a redundant array of independent disks (RAID), and the like) for storing files including the operating system, application programs (including, for example, a web browser application, a widget or gadget engine, and or other applications, as necessary), executable instructions and data. One, some, or all of the processing techniques or methods described herein can be implemented as a combination of executable instructions and data within the memory.

The controller 230 can also have a communication interface 236 for sending and receiving communication signals between the various components. Communication interface 236 can include hardware, firmware, and/or software that allows the processor(s) 234 to communicate with the other components via wired or wireless networks, whether local or wide area, private or public, as known in the art. Communication interface 236 can also provide access to a cellular network, the Internet, a local area network, or another wide-area network as suitable for the particular application.

Additionally, the controller 230 can have or be in communication with a user interface 238 for displaying system information and receiving inputs from a user. The user interface 238 can be installed locally or be a remote device such as a mobile device. The user, for example, can view system data on the user interface 238 and input data or commands to the controller 230 via the user interface 238. For example, the user can view threshold settings on the user interface 238 and provide inputs to the controller 230 via the user interface 238 to change a threshold setting.

Figure 1B:
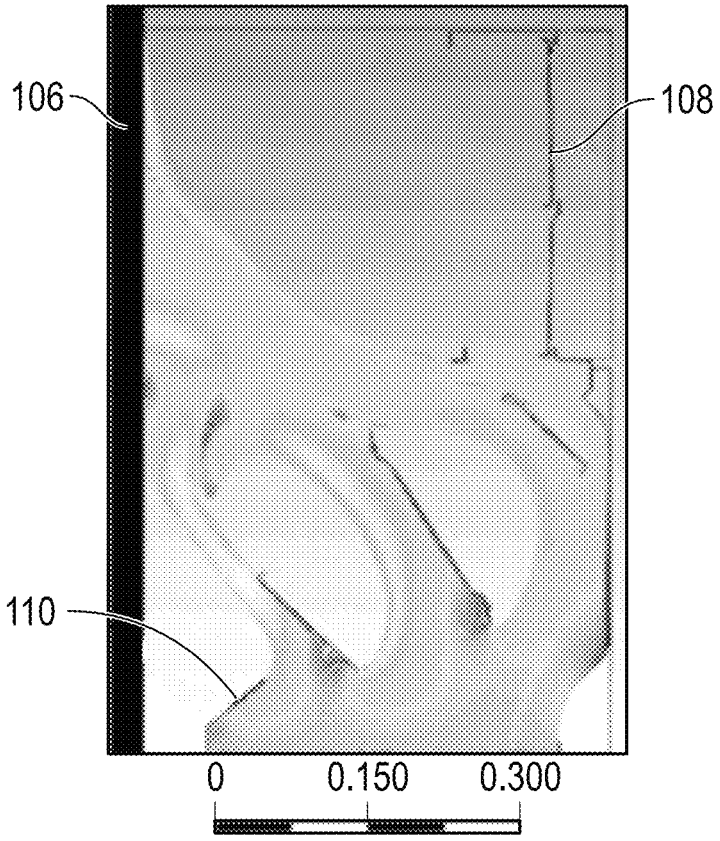
FIG. 1B (Prior Art)
FIG. 1B illustrates a flow analysis of airflow through an economizer of an existing HVAC system.
Figure 5B:
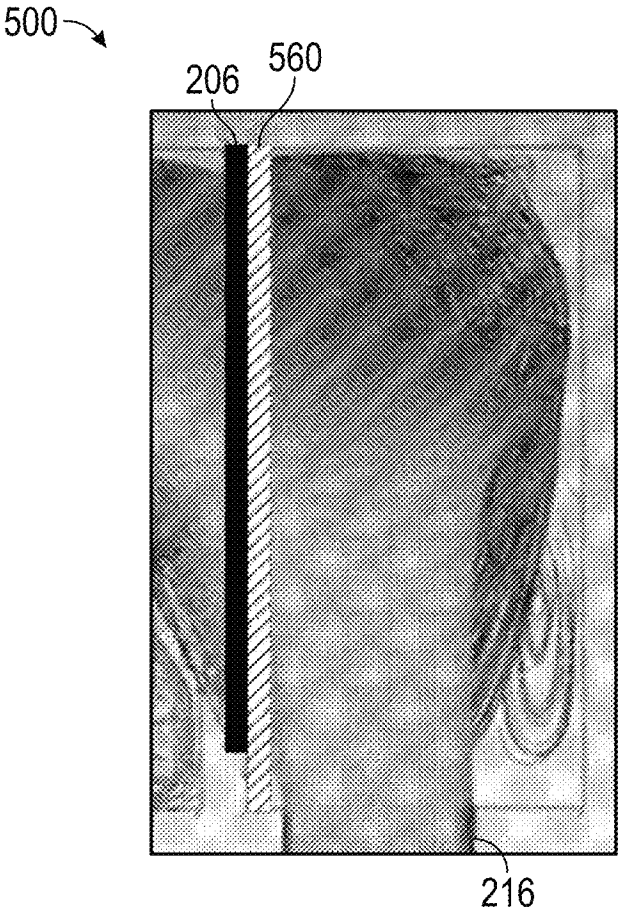
FIG. 5B illustrates a flow analysis of airflow through an example HVAC system having perforated plate, in accordance with the disclosed technology.
Figure 5A:
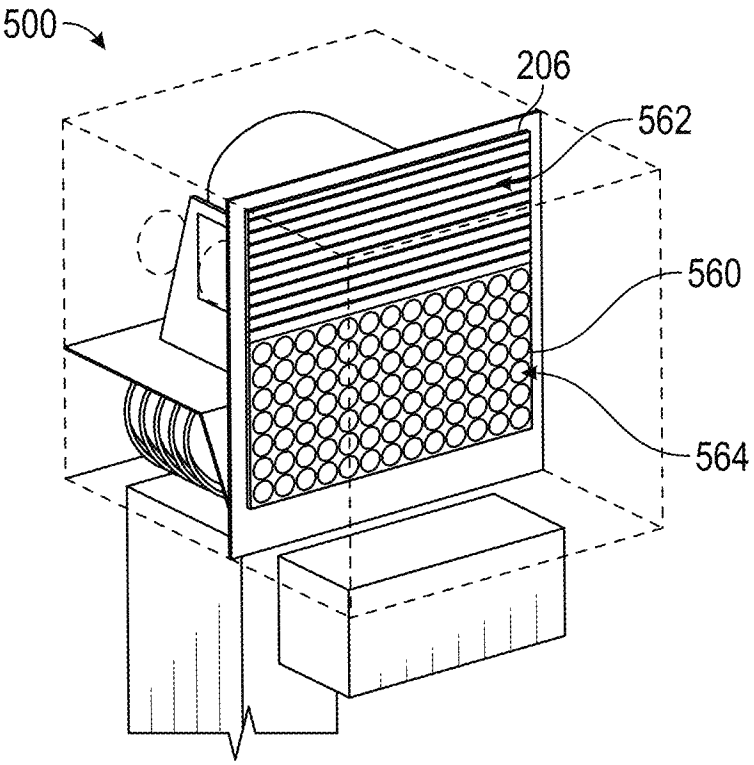
FIG. 5A illustrates a perspective view of perforated plate installed in an example HVAC system, in accordance with the disclosed technology.

FIG. 5A illustrates a perspective view of a perforated plate 560 installed in an HVAC system 500, in accordance with the disclosed technology. The perforated plate 560 can include at least first perforations 562 and second perforations 564 that can help guide return air across an outer surface of the evaporator 206 more evenly than without the perforated plate 560 (as illustrated in FIG. 5B). As described previously in relation to FIG. 1B, existing HVAC systems 100 can experience uneven airflow distribution across the evaporator 206 because of the configuration of the economizer 120. This can lead to inefficiencies in the HVAC system 100 because the evaporator 106 is not fully utilized. By incorporating a perforated plate 560 into the HVAC system 500, the HVAC system 500 can operate more efficiently because air is moved across a greater percentage of the outer surface of the evaporator 206 resulting in more efficient heat transfer between the air being moved across the outer surface of the evaporator 206 and the refrigerant passing through the evaporator.

As illustrated in FIG. 5A, the first perforations 562 can be located near a top portion of the perforated plate 560 while the second perforations 564 can be located near a bottom portion of the perforated plate 560. The first perforations 562 can comprise a smaller flow area than the second perforations 564. For example, the first perforations 562 can be smaller in size and collectively form a smaller flow area than the second perforations 564. In this way, the second perforations 564 can permit a greater amount of air to flow through the second perforations 564 than the first perforations 562. Thus, the perforated plate 560 can direct the air toward locations of the evaporator 206 that would normally receive a smaller amount of airflow to cause the air to be more evenly distributed across the outer surface of the evaporator 206.

Although depicted as having only the first perforations 562 and the second perforations 564, the disclosed technology can have any number of perforations having any shapes or sizes to ensure the air is evenly distributed across the outer surface of the evaporator 206. Furthermore, although depicted as having the first perforations 562 near the top portion of the perforated plate 560 and the second perforations 564 near the bottom portion of the perforated plate 560, the first perforations 562 and the second perforations 564 can be arranged in any suitable configuration to help ensure the air is evenly distributed across the outer surface of the perforated plate 560. For example, the first perforations 562 can be located near a center of the perforated plate 560 while the second perforations 564 can be located near the outer edges of the perforated plate 560. As another example, the first perforations can be located near the bottom of the perforated plate 560 while the second perforations can be located near the top of the perforated plate 560. In yet other examples, the first perforations 562 can be located near a first edge of the perforated plate 560 while the second perforations 564 can be located near a second edge of the perforated plate 560. As will be appreciated by one of skill in the art, the perforated plate 560 can include any number of configurations of perforations (including size, shape, position, and combination of various perforations) to distribute the air across the evaporator 206 more evenly than without the perforated plate 560.

Figure 6:
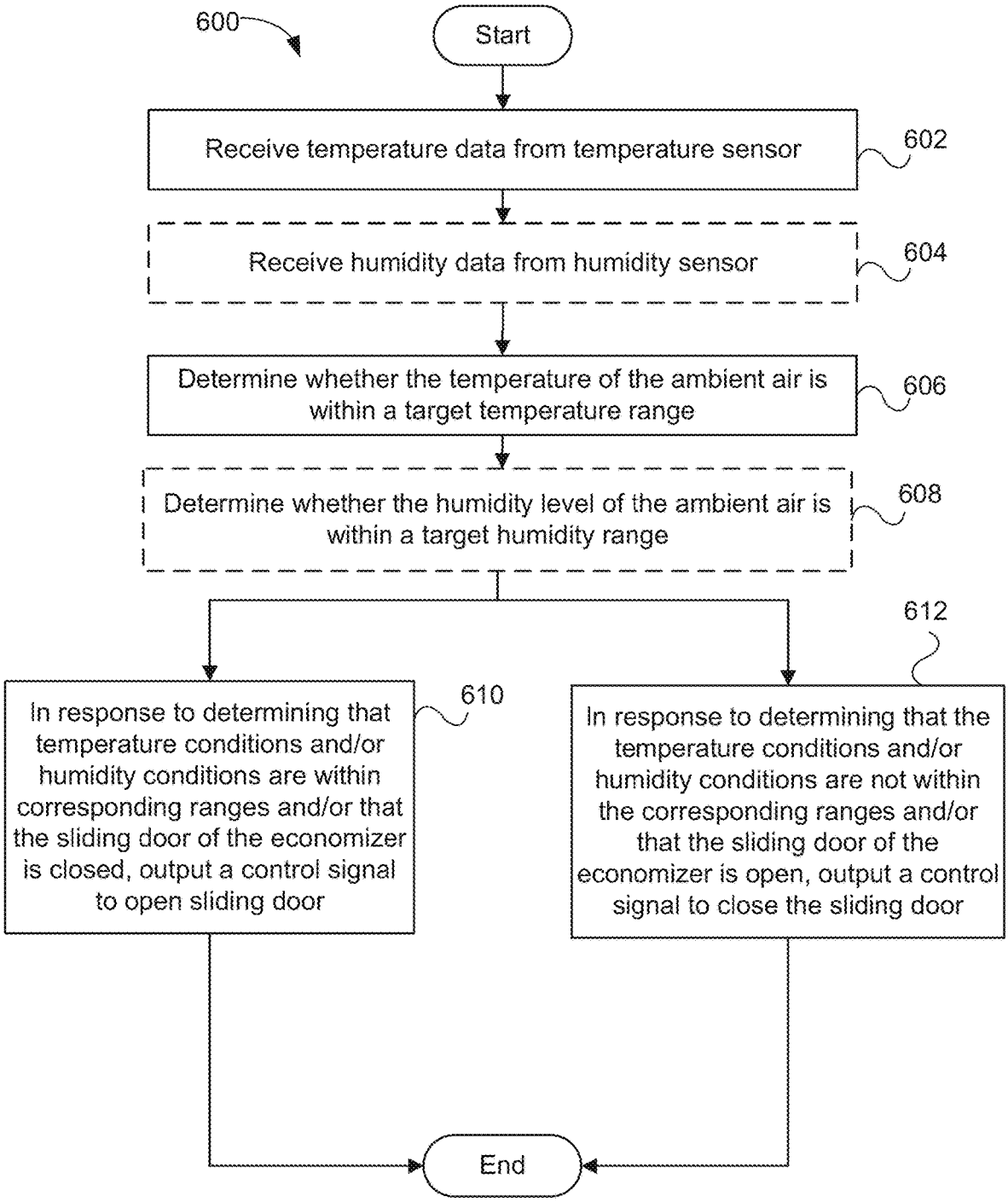
FIG. 6 illustrates a flow diagram of an example method of operating an economizer, in accordance with the disclosed technology.

FIG. 6 illustrates a flow diagram of an example method 600 of operating an economizer, in accordance with the disclosed technology. The method 600 can be executed or carried out by a computing device such as the controller 230 previously described. The method 600 can include receiving 602 temperature data from a temperature sensor (e.g., temperature sensor 240) that can be indicative of the temperature of the ambient air. Alternatively, or in addition, the method 600 can include receiving 604 humidity data from a humidity sensor (e.g., humidity sensor 242) that can be indicative of the humidity level of the ambient air. The method 600 can include determining 606, based on the temperature data, whether the temperature of the ambient air is within a target temperature range and/or determining 608, based on the humidity data, whether the humidity of the ambient air is within a target humidity range. The target temperature range, for example, can be a temperature range of the ambient air that would commonly be considered comfortable by an occupant of the building, and the target humidity range, for example, can be a humidity range of the ambient air that would commonly be considered comfortable by an occupant of the building. One or both of the target temperature range and the target humidity range can be predetermined (e.g., preprogrammed), and/or one or both of the target temperature range and the target humidity range can be received and/or determined from user-inputted data.

In response to determining that the temperature of the ambient air is within the target temperature range and/or the humidity of the ambient air is within the target humidity range, the method 600 can include outputting 610 a control signal to open the sliding door to permit ambient air to enter the building. Optionally, the method 600 can include confirming or determining that the sliding door of the economizer (e.g., sliding door 221) is closed before outputting 610 the control signal to open the sliding door to permit ambient air to enter the building. In this way, disclosed technology can permit the ambient air to be circulated through the building by the HVAC system to help maintain the temperature of the building within a comfortable temperature range.

In response to determining that the temperature of the ambient air is not within the target temperature range and/or the humidity of the ambient air is not within the predetermined humidity range, the method 600 can include outputting 612 a control signal to close the sliding door to prevent ambient air from entering the building. Optionally, the method 600 can include confirming or determining that the sliding door of the economizer is open before outputting 612 the control signal to open the sliding door to permit ambient air to enter the building. In this way, disclosed technology can ensure ambient air that is either too warm, too cool, or too humid is prevented from being circulated through the building by the HVAC system.

While the present disclosure has been described in connection with a plurality of example aspects, as illustrated in the various figures and discussed above, it is understood that other similar aspects can be used, or modifications and additions can be made to the described subject matter for performing the same function of the present disclosure without deviating therefrom. In this disclosure, methods and compositions were described according to aspects of the presently disclosed subject matter. But other equivalent methods or compositions to these described aspects are also contemplated by the teachings herein. Therefore, the present disclosure should not be limited to any single aspect, but rather construed in breadth and scope in accordance with the appended claims. Moreover, various aspects of the disclosed technology have been described herein as relating to methods, systems, devices, and/or non-transitory, computer-readable medium storing instructions. However, it is to be understood that the disclosed technology is not necessarily limited to the examples and embodiments expressly described herein. That is, certain aspects of a described system can be included in the methods described herein, various aspects of a described method can be included in a system described herein, and the like.

What is claimed is:

1. An economizer for a heating, ventilation, and air conditioning (HVAC) system, the economizer comprising:
a housing;
an air inlet extending through a wall of the housing;
a sliding door configured to transition between a closed position and an open position, the sliding door comprising:
a first portion forming a barrier, and a second portion comprising at least one aperture, wherein when the sliding door is in the closed position: (i) the first portion is aligned with the air inlet in a vertical orientation and configured to substantially prevent ambient air from moving through the air inlet, and (ii) the second portion is disposed in a first non-vertical orientation; and
wherein when the sliding door is in the open position (i) the second portion is aligned with the air inlet in the vertical orientation and configured to permit the ambient air to move through the air inlet via the at least one aperture, and (ii) the first portion is disposed in a second non-vertical orientation; and
a controller in communication with a temperature sensor of the HVAC system, the controller being configured to:
receive temperature data from the temperature sensor, the temperature data being indicative of a temperature of ambient air;
in response to determining that the temperature of the ambient air is within a predetermined temperature range, output a first control signal to transition the sliding door to the open position; and
in response to determining that the temperature of the ambient air is not within the predetermined temperature range, output a second control signal to transition the sliding door to the closed position.

2. The economizer of claim 1, wherein the controller is further configured to:
receive humidity data from a humidity sensor of the HVAC system, the humidity data being indicative of a humidity of ambient air;
in response to determining that the humidity of the ambient air is within a predetermined humidity range, output a third control signal to transition the sliding door to the open position; and
in response to determining that the humidity of the ambient air is not within the predetermined humidity range, output a fourth control signal to transition the sliding door to the closed position.

3. The economizer of claim 1, further comprising a motor configured to transition the sliding door between the closed position and the open position.

4. The economizer of claim 1, wherein the first portion comprises a plurality of panels configured to align to create a seal and prevent airflow.

5. The economizer of claim 4, wherein the sliding door further comprises a plurality of sealing elements affixed to the plurality of panels such that, when the plurality of panels are planarly aligned, the plurality of sealing elements create a seal between adjacent panels of the plurality of panels.

6. The economizer of claim 1, wherein the second portion comprises a screen.

7. The economizer of claim 1, wherein the second portion comprises a plurality of louvers.

8. The economizer of claim 1, wherein the second portion comprises a plurality of panels, wherein each of the plurality of panels are spaced apart from each other such that the plurality of panels permits the ambient air to be drawn into the housing.

9. The economizer of claim 1 further comprising a barometric relief damper configured to permit at least a portion of return air to exit the housing, wherein when the sliding door is in the open position, the sliding door is configured to direct the at least a portion of the return air toward the barometric relief damper to exit the housing.

10. The economizer of claim 1, wherein the sliding door is configured to move along a track.

11. The economizer of claim 10, wherein the track is configured to direct the first portion of the sliding door into an airflow path of return air to at least partially obstruct the airflow path of return air when the sliding door is in the open position.

12. An HVAC system comprising:
a heat exchanger;
an air moving device configured to move air across an outer surface of the heat exchanger; and
an economizer comprising:
a housing;
an air inlet extending through a wall of the housing;
a sliding door configured to transition between a closed position and an open position, the sliding door comprising:
a first portion forming a barrier, and a second portion comprising at least one aperture, wherein when the sliding door is in the closed position: (i) the first portion is aligned with the air inlet in a vertical orientation, and (ii) the second portion is disposed in a first non-vertical orientation; and
wherein when the sliding door is in the open position (i) the second portion is aligned with the air inlet in the vertical orientation, and (ii) the first portion is disposed in a second non-vertical orientation.

13. The HVAC system of claim 12 further comprising a compressor, wherein the controller is further configured to:
output a first control signal to the compressor to cause the compressor to circulate refrigerant through the heat exchanger when the sliding door is in the closed position; and
output a second control signal to the compressor to cause the compressor to deactivate when the sliding door is in the open position.

14. The HVAC system of claim 12 further comprising a perforated plate configured to direct return air across the heat exchanger.

15. The HVAC system of claim 14, wherein the perforated plate comprises a first portion having a first plurality of perforations having a first cumulative flow area and a second portion having a second plurality of perforations having a second cumulative flow area, the first cumulative flow area being greater than the second cumulative flow area.

16. A heating, ventilation, and air conditioning (HVAC) system comprising:
a heat exchanger;
an air moving device configured to move air across an outer surface of the heat exchanger; and
a perforated plate configured to direct a flow of the air moved across the outer surface of the heat exchanger, the perforated plate comprising:
a first portion having a first plurality of perforations having a first cumulative flow area, and a second portion having a second plurality of perforations having a second cumulative flow area, wherein the first cumulative flow area is greater than the second cumulative flow area and is configured to permit a greater amount of the air to pass across the outer surface of the heat exchanger than the second cumulative flow area; and an economizer comprising a sliding door configured to be transitioned between a closed position and an open position, the sliding door comprising:

a first portion forming a barrier, and a second portion comprising at least one aperture, wherein when the sliding door is in the closed position, the first portion is aligned with an air inlet of the heat exchanger in a vertical orientation, and the second portion is disposed in a first non-vertical orientation, and when the sliding door is in the open position, the second portion is aligned with the air inlet of the heat exchanger in the vertical orientation, and the first portion is disposed in a second non-vertical orientation.

17. The HVAC system of claim 16 further comprising:

a controller in communication with a temperature sensor of the HVAC system, the controller being configured to:

receive temperature data from the temperature sensor, the temperature data being indicative of a temperature of ambient air;

in response to determining that the temperature of the ambient air is within a predetermined temperature range, output a first control signal to transition the sliding door to the open position; and in response to determining that the temperature of the ambient air is not within the predetermined temperature range, output a second control signal to transition the sliding door to the closed position.

18. The economizer of claim 17, wherein the controller is further configured to:

receive humidity data from a humidity sensor of the HVAC system, the humidity data being indicative of a humidity of ambient air;

in response to determining that the humidity of the ambient air is within a predetermined humidity range, output a third control signal to transition the sliding door to the open position; and in response to determining that the humidity of the ambient air is not within the predetermined humidity range, output a fourth control signal to transition the sliding door to the closed position.

19. The HVAC system of claim 17 further comprising a track configured to direct the first portion of the sliding door into an interior of the economizer to at least partially obstruct an airflow path of return air when the sliding door is in the open position.

20. The HVAC system of claim 17 further comprising a compressor, wherein the controller is further configured to:

output a first control signal to the compressor to cause the compressor to circulate refrigerant through the heat exchanger when the sliding door is in the closed position; and output a second control signal to the compressor to cause the compressor to deactivate when the sliding door is in the open position.

* * * * *